US010994432B2

(12) United States Patent
Hayes

(10) Patent No.: US 10,994,432 B2
(45) Date of Patent: May 4, 2021

(54) CUTTING TOOL

(71) Applicant: Daniel C Hayes, Grand Junction, UT (US)

(72) Inventor: Daniel C Hayes, Grand Junction, UT (US)

( * ) Notice: Subject to any disclaimer, the term of this patent is extended or adjusted under 35 U.S.C. 154(b) by 27 days.

(21) Appl. No.: 16/693,059

(22) Filed: Nov. 22, 2019

(65) Prior Publication Data

US 2020/0086511 A1 Mar. 19, 2020

(51) Int. Cl.
*B26B 5/00* (2006.01)

(52) U.S. Cl.
CPC ..... *B26B 5/006* (2013.01); *B26B 5/005* (2013.01)

(58) Field of Classification Search
CPC ..... B26D 5/006; B26D 5/005; B26B 5/006; B26B 5/005
See application file for complete search history.

(56) References Cited

U.S. PATENT DOCUMENTS 6,722,044 B2 * 4/2004 Timidaiski ..... B26B 5/005 30/329
9,333,643 B2 * 5/2016 Brallier ..... B25H 7/045
9,719,912 B2 * 8/2017 Liang ..... B26B 5/002
2014/0068951 A1 * 3/2014 Quimby ..... B26B 9/00 30/298.4

* cited by examiner

*Primary Examiner* — Omar Flores Sanchez
(74) *Attorney, Agent, or Firm* — Sam IP Legal Solutions, P.C.; Ryan D. Sam

(57) ABSTRACT

A cutting tool having multiple functional faces and an adjustable blade. The cutting tool may include a solid body having multiple functional faces, a blade, and a peg. The multiple faces of the solid body may include a cutting face, a gripping face, a base face, one or more securing faces and a pressure face. The cutting face may be curved and may form a receiving bay for receiving an item to be cut and may include a plurality of slots. The blade may be secured in any one slot of the plurality of slots. The peg may help to secure the blade within the cutting face. The cutting tool may also include a compartment for storing extra blades.

20 Claims, 14 Drawing Sheets

CUTTING TOOL

BACKGROUND OF THE INVENTION

A great variety of knives, cutters, safety cutters, and cutter apparatuses are known in the art. Features variously found in prior art knives, cutters, safety cutters, and cutter apparatuses include mechanisms and devices facilitating, for example, blade deployment, blade locking, blade depth adjustment, the ability to change blades, and the ability to store the blade when not in use. Various handle designs and ergonomic designs are also known in the art.

Many people have and regularly use the common retractable blade utility knife for a variety of household and work-related projects. For example, these types of knives may be used to open boxes, cut down cardboard, cutting straight lines in a variety of different materials, scrapping off paint from surfaces, making marking or scoring lines in a variety of different materials, etc.

While these types of knives are useful in a variety of different applications, it may be hard to use them in other applications. For example, it may be hard to use the common retractable blade utility knife for cutting that requires rotation such as cutting pipes or cutting other rounded surfaces. With these types of knives, it may be hard to produce straight lines or cuts when rotational cutting is required or when cutting rounded surfaces.

Accordingly, there has been an ongoing need for improvements in utility knives. Therefore, new designs and functional features for utility type knives would be well received by the general public.

SUMMARY OF THE INVENTION

Various embodiments of the cutting tool may include a solid body with multiple functional faces, a blade, and a peg. The solid body may be made of a hard and durable material such as a type of plastic. The multiple functional faces may include a cutting face, a pressure face, one or more securing faces, a gripping face, and a base face. The surface of the cutting face may be curved inward so as to form a receiving bay for an item to be cut. The cutting face may include a plurality of slots in which the blade may be inserted into. The plurality of horizontal slots may be positioned at convenient intervals for measurement, such as at one-eighth inch intervals. The cutting face may further include measurement indicia made up of varying sized horizontal lines and numerals. Measurement indicia may be associated with each of the plurality of slots and indicate the height of each slot from a bottom edge of the cutting face.

The pressure face of the solid body may be the most superior face of the solid body. The pressure face may provide a flat surface in which the user may press down on when using the cutting tool. The one or more securing faces may be positioned inferiorly to the pressure face and may include apertures designed to receive a screw such that the solid body of the cutting tool may be secured to a workbench or other flat surface.

The gripping face may be curved in a way that it fits ergonomically in the human hand. The gripping face may form lateral sides and a back of the solid body and may be used to grip the cutting tool while the cutting tool is in use.

The base face of the cutting tool may form a base of the solid body. The base face may provide a large and flat surface area such that the solid body may be stable and not tip over or wobble when placed on a workbench or other flat surface.

The solid body may also include a plurality of apertures. The plurality of apertures may be vertically positioned and in line with each other such that the peg may be inserted through the plurality of apertures. The blade may also have an aperture such that when it is placed in any one of the plurality of slots in the cutting face, the aperture of the blade may line up with the plurality of apertures of the solid body. In this manner, the blade may be secured within the cutting face.

The solid body may also include a compartment. The compartment may be located between a first securing face and a second securing face and may be positioned inferiorly to the pressure face. The compartment may hold a number of spare or extra blades for replacing the blade secured in the cutting face when the blade secured in the cutting face dulls or otherwise becomes unusable.

Other features and advantages of the various embodiments of the cutting tool will become apparent from the following more detailed description, taken in conjunction with the accompanying drawings, which illustrate, by way of example, the principles of the various embodiments of the cutting tool.

BRIEF DESCRIPTION OF THE DRAWINGS

Various embodiments will be described and explained with additional specificity and detail through the use of the accompanying drawings in which.

DETAILED DESCRIPTION OF THE PREFERRED EMBODIMENTS

Figure 1:
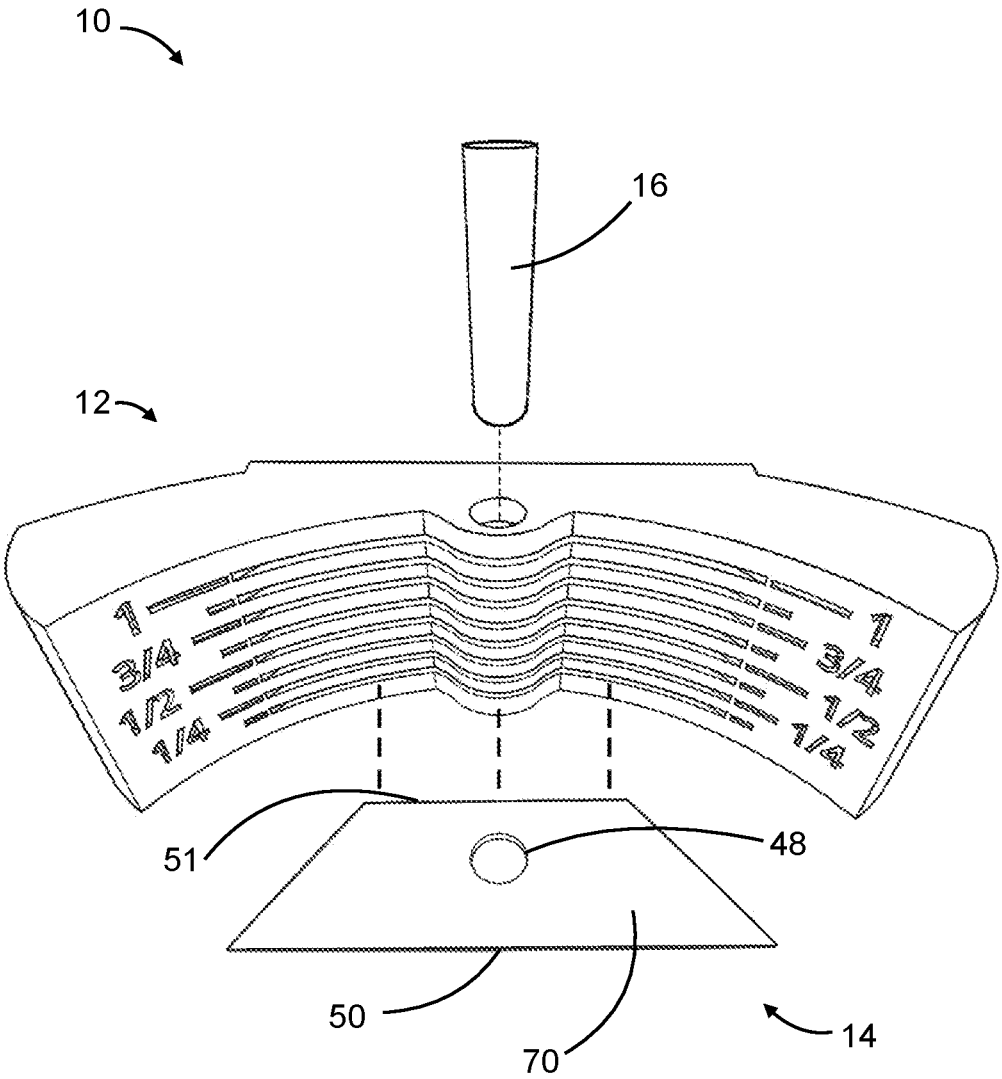
FIG. 1 illustrates an exploded front perspective view of a cutting tool.

As shown in the drawings and for purposes of illustration, the one or more embodiments disclose herein illustrate a cutting tool, generally referred to herein by the reference numeral 10. Generally, the cutting tool 10 may be comprised of a solid body 12, a blade 14, and a peg 16. The solid body 12 may be made from a hard and durable material such as plastic, metal, wood, or other hard and durable material known in the art. The blade 14 may be made from ceramic, steel or other material known in the art and commonly used for making blades. The blade 14 may be a type of blade commonly used in the art as the blades for utility knives. The blade 14 may be designed to cut through a variety of different materials including, but not limited to, plastic, vinyl, fabric, tape, coats of epoxy, rubber, cardboard, etc. Furthermore, the blade 14 may be designed to make scoring lines in ceramic, glass, plastic, steel, taped surfaces, painted surfaces, etc. The peg 16 may be made from a hard and durable material such as plastic, metal, wood, or other hard and durable material known in the art. The peg 16 may be made of the same material as the solid body 12 or may be made from a different material from the solid body 12 as long as it is made from a material that is hard and durable.

Figure 2:
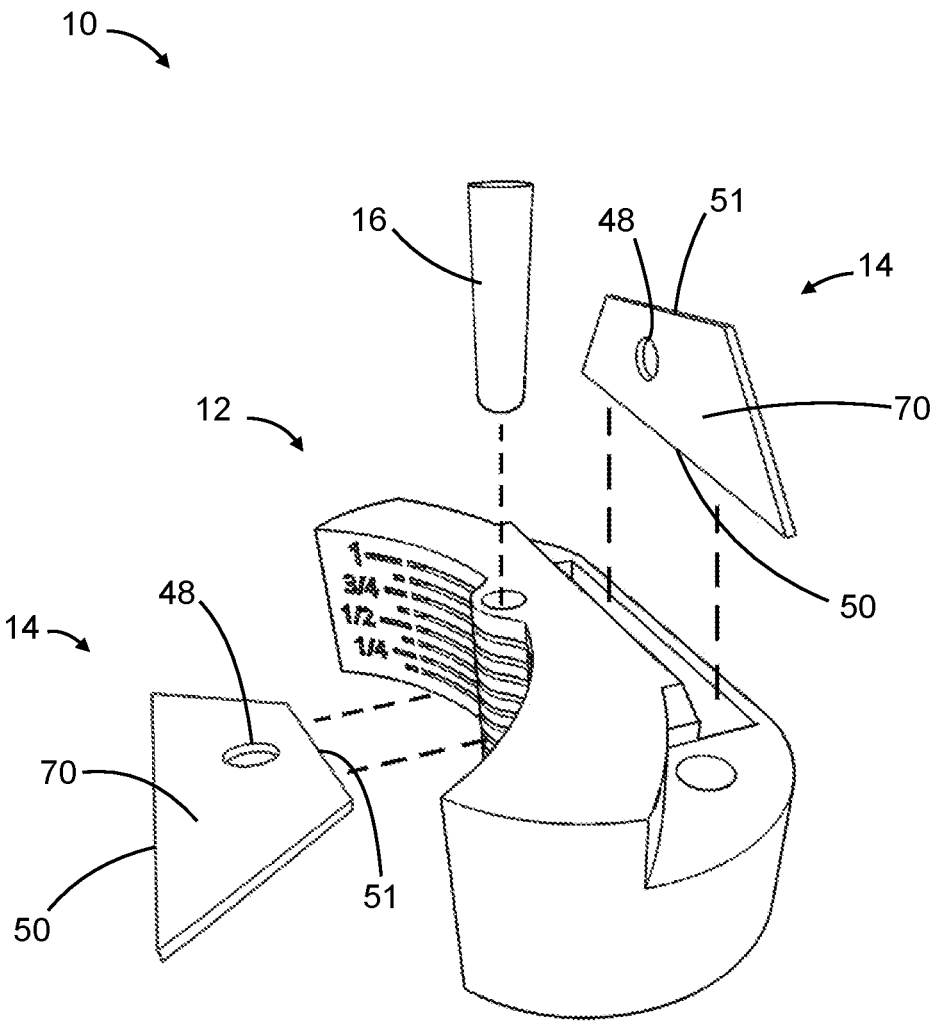
FIG. 2 illustrates an exploded side perspective view of the cutting tool of FIG. 1.
Figure 3:
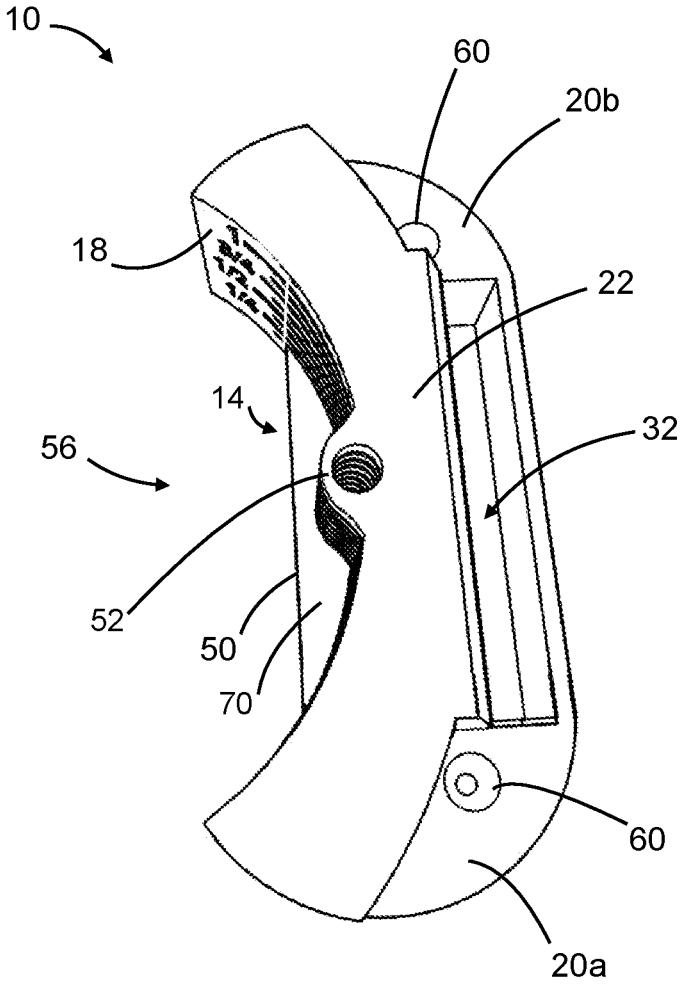
FIG. 3 illustrates a top perspective view of the cutting tool of FIGS. 1-2.
Figure 4:
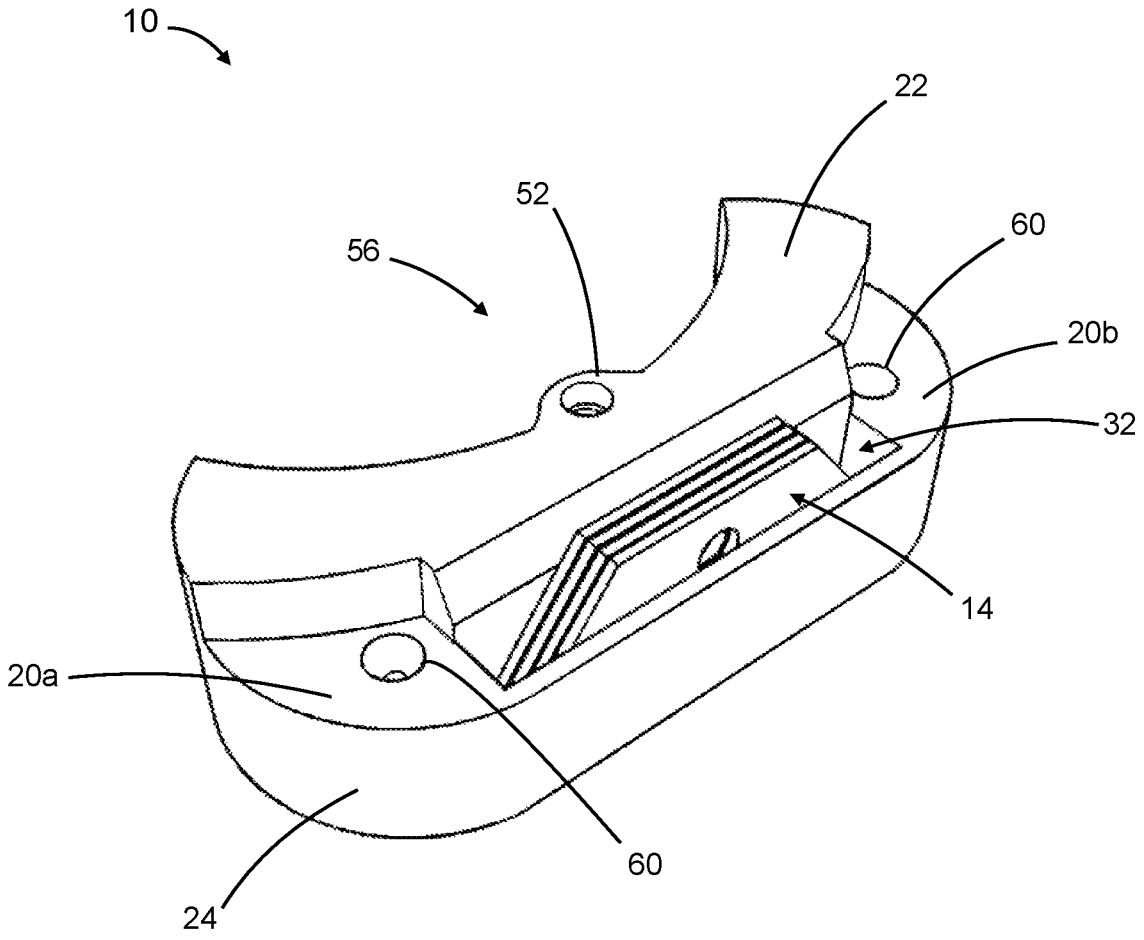
FIG. 4 illustrates a back perspective view of the cutting tool of FIGS. 1-3.
Figure 5:
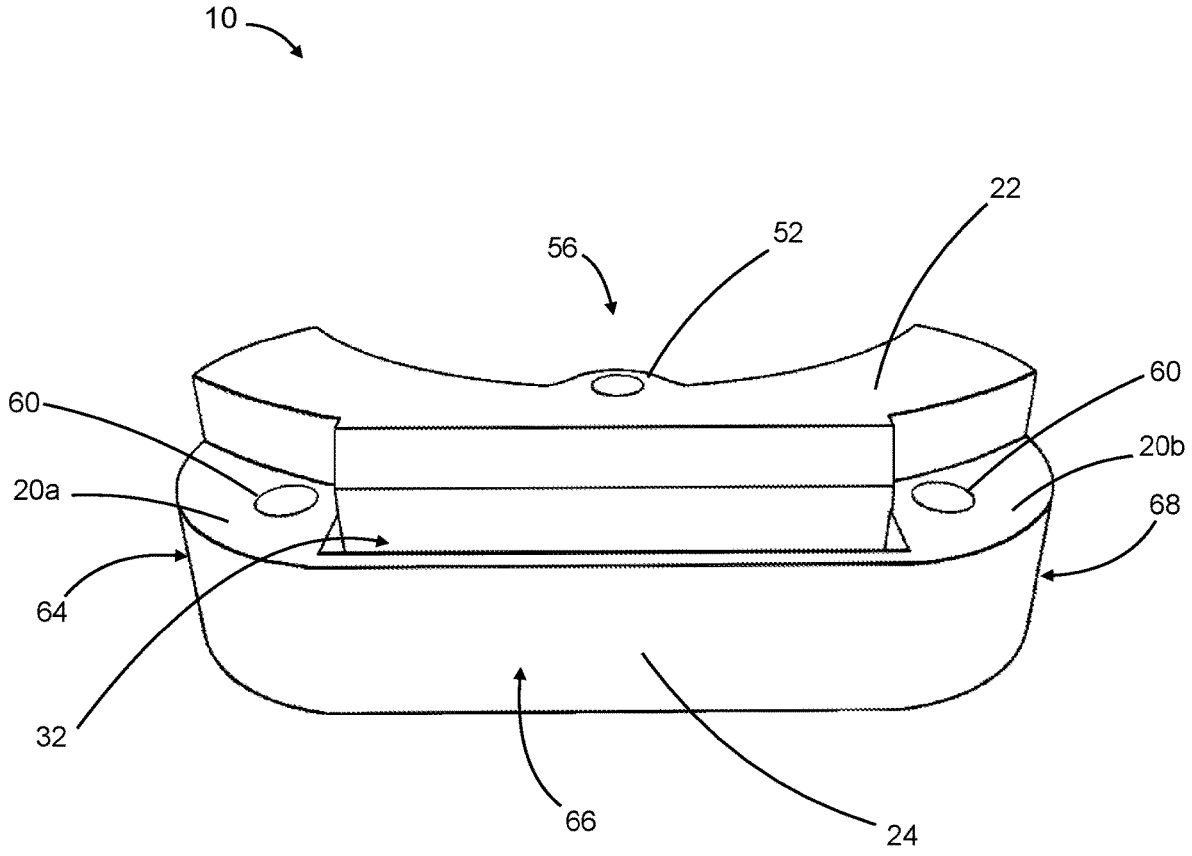
FIG. 5 illustrates a front perspective view of the cutting tool of FIGS. 1-4.

With reference know to FIGS. 1-2, various components of the cutting tool 10 are illustrated. As mentioned above, the cutting tool 10 may be comprised of a solid body 12, a blade 14, and a peg 16. More specifically, the solid body 12 may be comprised of multiple functional faces. For example, the solid body 12 may be comprised of a cutting face 18, one or more securing faces 20*a* and 20*b*, a pressure face 22, a gripping face 24, and a base face 26. As can be seen from the drawings, the cutting face 18 may face forward and may be located in an anterior position on the solid body 12. Furthermore, the cutting face 18 may curve inward such that a first side edge 28 of the cutting face 18 and a second side edge 30 of the cutting face 18 are located more anteriorly than the rest of the surface of the cutting face 18. The one or more securing faces 20*a* and 20*b* and the pressure face 22 may face upwards and may be generally perpendicular to the cutting face 18 and may be generally parallel to each other. The pressure face 22 and the one or more securing faces 20*a* and 20*b* may be in different planes with the pressure face 22 being located superior to the one or more securing faces 20*a* and 20*b*. Alternatively, the pressure face 22 and the one or more securing faces 20*a* and 20*b* may be located in the same plane. The base face 26 may point downwards and form a base of the solid body 12. The base face 26 may be located inferior to the pressure face 22 and to the one or more securing faces 20*a* and 20*b* and may be generally orthogonal to the cutting face 18. The gripping face 24 may be curved forming the lateral sides and back of the solid body 12. The gripping face 24 may begin at the first side edge 28 of the cutting face 18, wrap around and form a first lateral side 64 of the solid body 12, a back 68 of the solid body 12, a second lateral side 68 of the solid body 12, and end at the second side edge 20 of the cutting face 18. The gripping face 24 may have a curve so as to ergonomically fit within the natural curve of the human hand when the human hand is relaxed.

As mentioned above, the blade 14 may the type of blade commonly used in retractable utility knives known in the art. The blade may be comprised of a sharp edge 50 and a spine 51, wherein the spine 51 is opposite of the sharp edge 50. The blade 14 may further include an aperture 48 through a body 70 of the blade 14 between the spine 51 and the shape edge 50 of the blade 14. The aperture 48 may be positioned in the middle of the body of the blade and closer to the spine 51 of the blade than the sharp edge 50 of the blade 14.

With reference now specifically to FIGS. 2-6, the solid body 12 may also be comprised of a compartment 32. As shown in the figures, the compartment 32 may be used to store extra blades 34. The extra blades 34 may be used as replacements when the blade 14 dulls or otherwise becomes unusable. The compartment 32 may be positioned proximal to the one or more securing faces 20*a* and 20*b* of the solid body 12. In one embodiment, the compartment 32 may be located in-between and adjacent to a first securing face 20*a* and a second securing face 20*b*.

Figure 7:
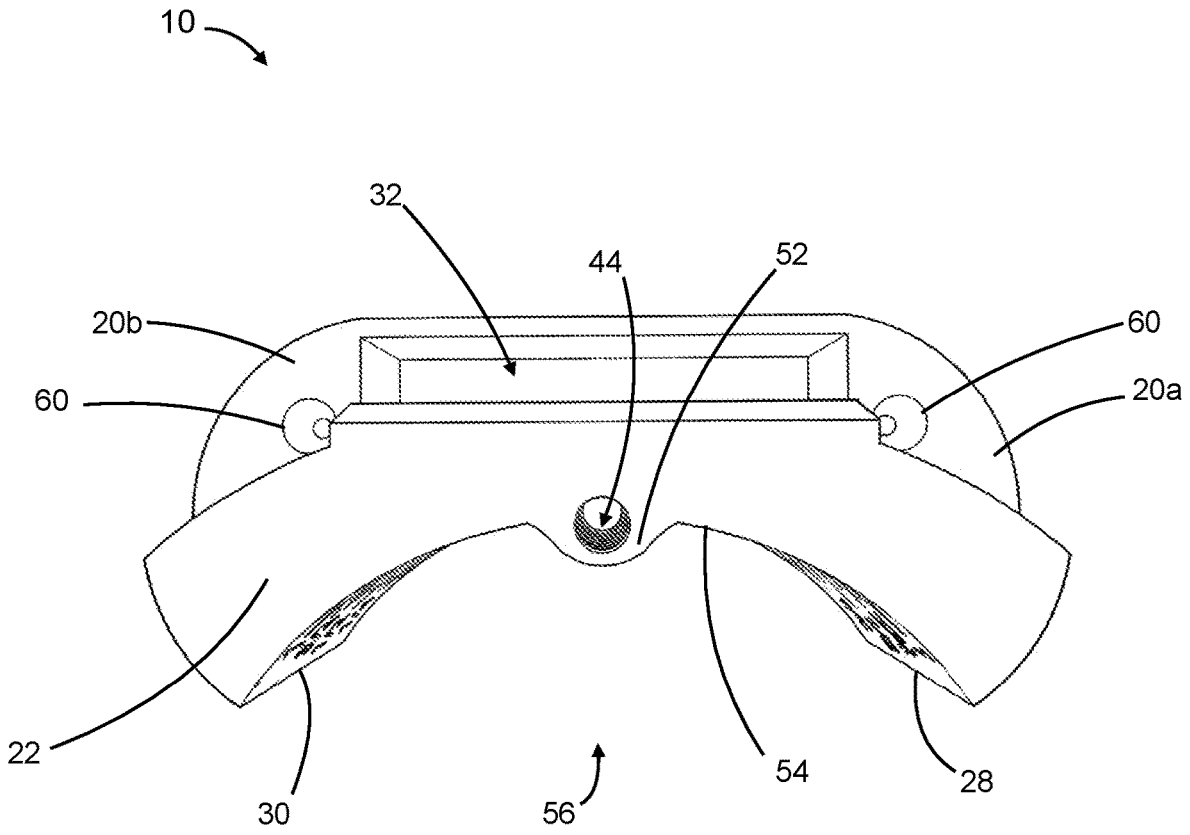
FIG. 7 illustrates a back perspective view of the cutting tool of FIGS. 1-6.
Figure 8:
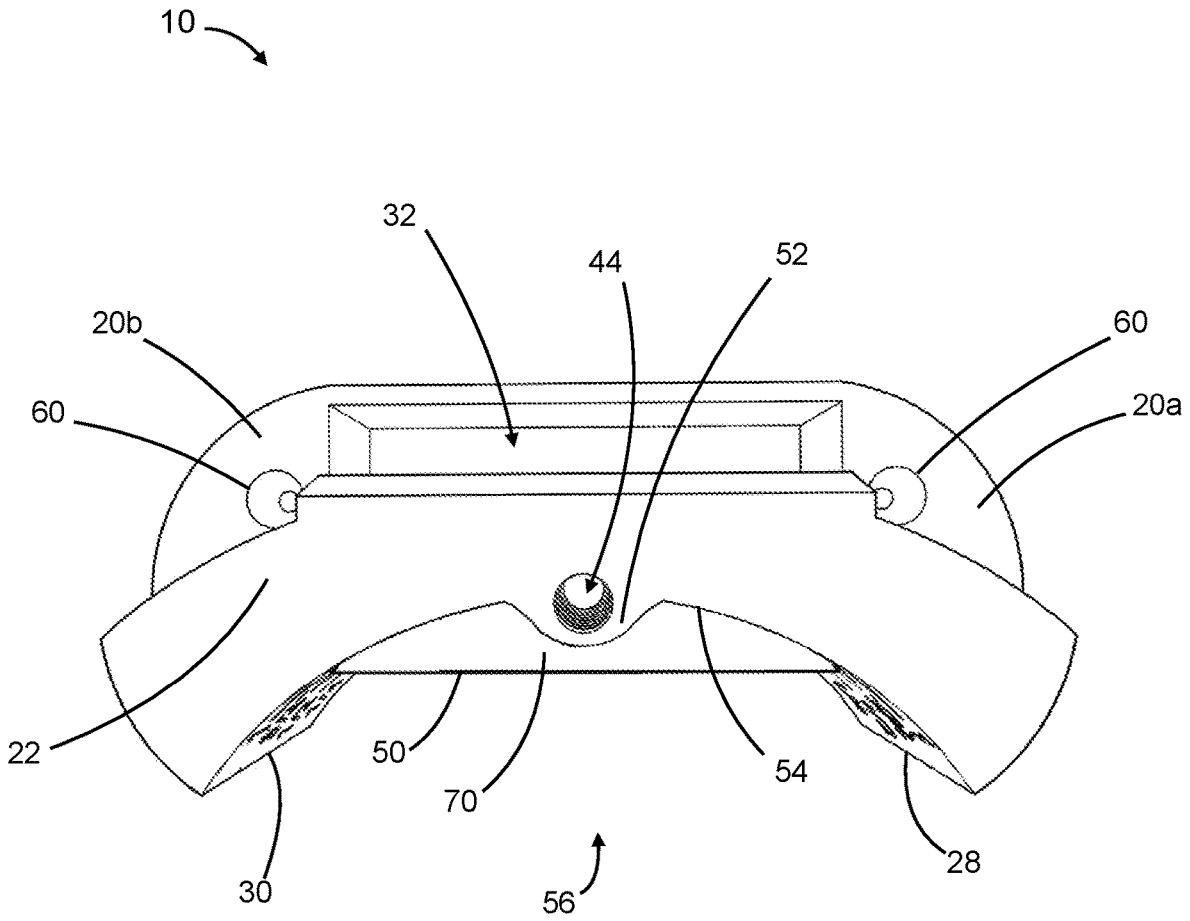
FIG. 8 illustrates a back perspective view of the cutting tool of FIGS. 1-7 similar to FIG. 7, but with extra blades stored in a storage compartment.
Figure 9:
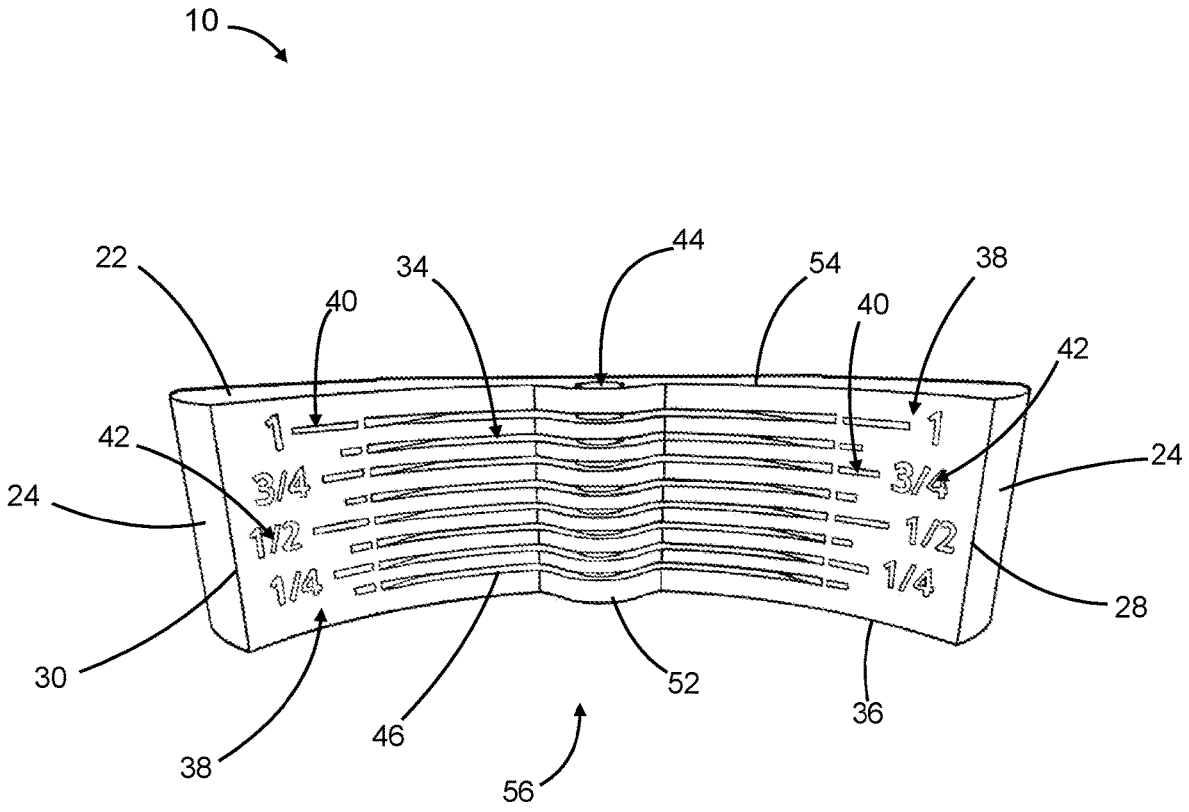
FIG. 9 illustrates a top perspective view of the cutting tool of FIGS. 1-8 without a blade.
Figure 10:
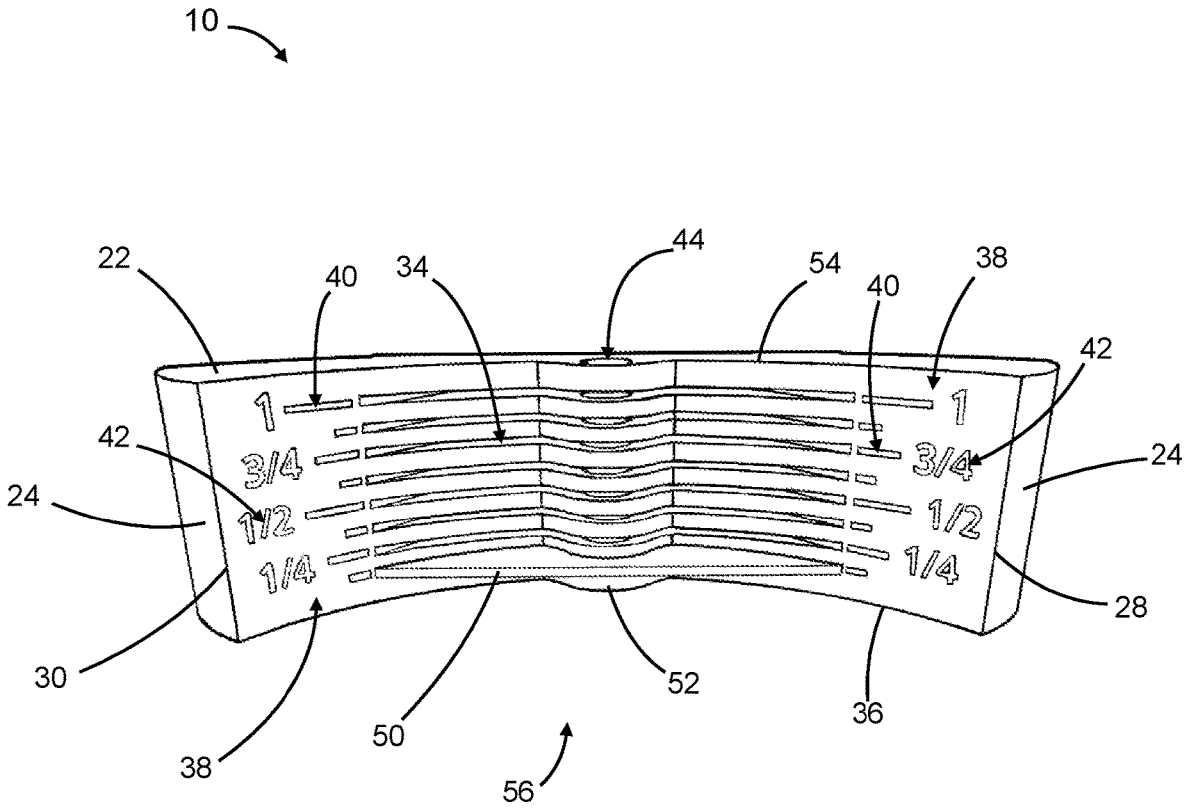
FIG. 10 illustrates a top perspective view of the cutting tool of FIGS. 1-9 with a blade.

With reference now to FIGS. 7-12, the blade 14 may be inserted into and secured within the cutting face 18. FIGS. 7-12 show a number of views of the cutting tool 10 with and without the blade 14 within the cutting face 18. The cutting tool 10 is designed so that the blade 14 may be easily and quickly removed and also easily and quickly put in place within the cutting face 18. The cutting tool 10 is also designed such that the blade 14 may be placed in different positions such that different sizes of cuts may be easily made according to the user's needs and desires. As best seen in FIGS. 9 and 10, the cutting tool 10 may further be comprised of a plurality of slots 34 within the cutting face 18. The plurality of slots 34 may be made horizontally within the cutting face 18. Furthermore, the plurality of slots 34 may be evenly spaced apart within the cutting face 18 so as to be located at convenient intervals for cutting. For example, a first slot of the plurality of slots 34 may be positioned at one-eighth of an inch from a bottom edge 36 of the cutting face 18. The next slot of the plurality of slots 34 may be positioned at one-fourth of an inch from the bottom edge 36 of the cutting face 18. The next slot of the plurality of slots may be positioned at three-eighths of an inch from the bottom edge 36 of the cutting face 18. The rest of the slots of the plurality of slots 34 may be positioned in like pattern progressing by one-eighth of an inch intervals. The range of the plurality of slots 34 may be, but is not limited to, from one-eighth of an inch to one inch in one-eighth of an inch intervals. In different embodiments, the range may extend even further, for example, the range may extend from one-eighth of an inch to two inches, to three inches, three and one-half inches, etc. Furthermore, the intervals of the plurality of slots 34 are not limited to one-eighth of an inch intervals, but may be in quarter-inch intervals, in half-inch intervals, etc. Additionally, the intervals of the plurality of slots 34 may be in centimeters. For example, the intervals may be one-centimeter intervals, half-centimeter intervals, etc.

The plurality of slots 34 may be designed such that a blade 14, as described above, may fit securely and snuggly inside of the slot with the spine 51 of the blade 14 within the slot and the sharp edge 50 of the blade 14 out of the slot and facing away from the cutting face 18. Furthermore, the plurality of slots 34 may be designed such that when a blade 14 is fit in any of the plurality of slots 34, the sharp edge 50 of the blade 14 becomes flush with the surface of the cutting face 18 on the horizontal. For example, in this position, the sharp edge 50 of the blade 14 may be positioned within any one of the plurality of slots 34 such that, in the horizontal plane of the blade 14 going from the first side edge 28 of the cutting face 18, along the surface of the cutting face 18, along the sharp edge 50 of the blade 14, along the opposite surface of the cutting face 18 to the second side edge 30 of the cutting face 18, there is no notch, wall or other irregularity, but only change in curvature and angle.

The blade 14 may be secured within any of the plurality of slots 34 in a variety of different ways. For example, as described above, the blade 14 may be secured within any of the plurality of slots 34 due to the design of the plurality of slots 34 being designed to be just big enough that the spine 51 of the blade 14 can be pushed with any of the slots 34, but not too big such that the blade 14 is loose or wobbly within the any of the plurality of slots 34. The material used to make the solid body 12 may also play a role in securing the blade 14 within any of the plurality of slots 34. It may be preferable for the solid body 12 to be made from a type of plastic or other hard, yet flexible material. For example, when the solid body 12 is made from a plastic or similar material, the portions of the cutting face 18 between each of the plurality of slots may be rigid, but somewhat flexible. Thus, the spine 51 of the blade 14 may be pushed into any of the plurality of slots 34 and the portion of the cutting face 18 directly above or below the slot and blade 34 may flex to allow the blade 14 to enter the slot and then continue to apply pressure to the blade 14 when the blade 14 is in the slot.

Figure 12:
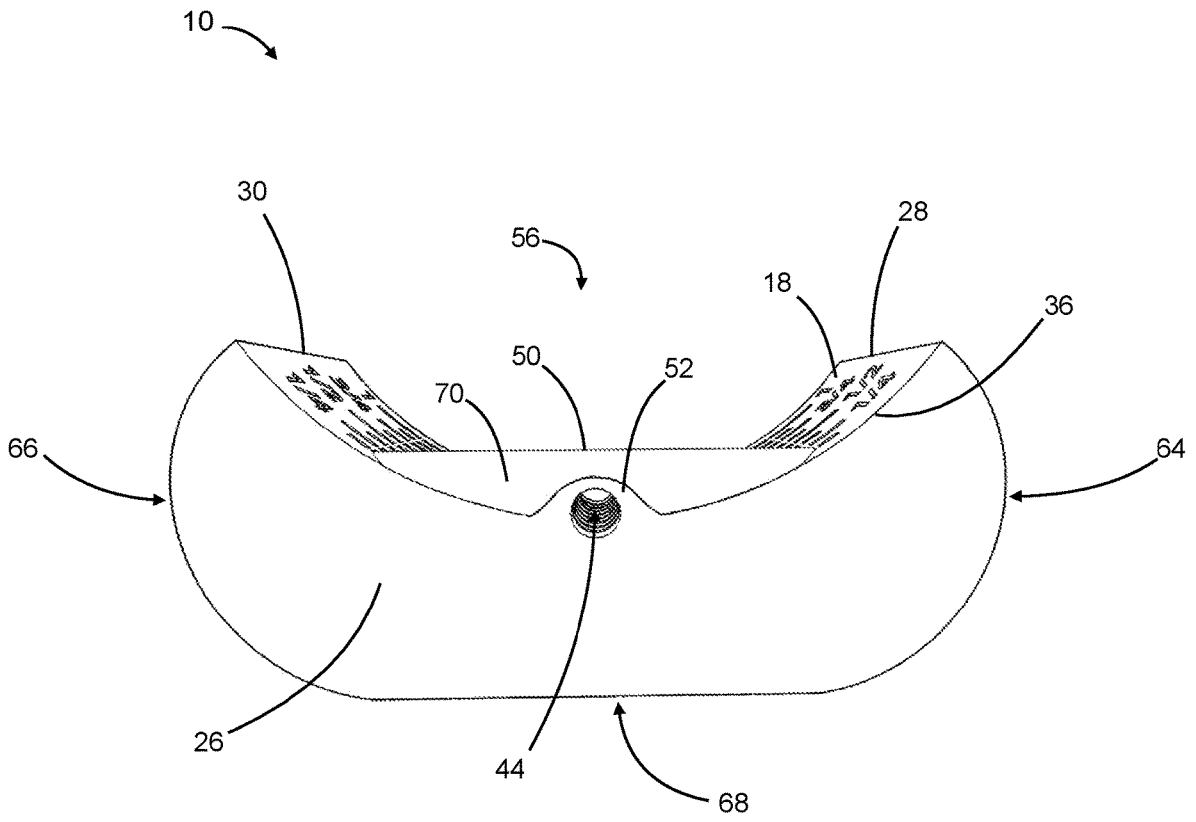
FIG. 12 illustrates a bottom perspective view of the cutting tool of FIGS. 1-11 with a blade.

Alternatively or additionally, the cutting tool 10 may be comprised of a plurality of apertures 44 for assisting in securing the blade 14 within any of the plurality of slots 34. The plurality of apertures 44 may extend in line and vertically though the pressure face 22 and through the top and bottom surfaces of each of the plurality of slots 34, except for the bottom surface of the first slot 46 which may not include an aperture. In this embodiment, the blade 14 may have an aperture 48 that lines up with the plurality of apertures 44 when the blade is placed within any of the plurality of slots 34 with the sharp edge 50 facing away from the cutting face 18. This is best seen in FIGS. 8 and 12. After the blade 14 is positioned within any of the plurality of slots 34, the peg 16, may be placed through the plurality of apertures 44 and the aperture 48 of the blade 14. The peg 16 placed in this manner helps to secure the blade 14 within the cutting tool 10 such that the blade 14 does not become loose and fall out of the cutting tool 10 when the cutting tool 10 is in use.

In one embodiment, the cutting tool may be comprised of a protuberance 52 on the surface of the cutting face 18. The protuberance 52 may be a bump extending vertically out of the surface of the cutting face 18 from the bottom edge 36 of the cutting face 18 to a top edge 54 of the cutting face 18. The protuberance 52 may be positioned vertically in the middle of the cutting face 18 such that the protuberance 52 divides the cutting face 18 into two equally sized sections. The protuberance 52 may be divided into a plurality of thin sections by the plurality of slots 34 as best seen in FIGS. 1, 9 and 10. The sections of the protuberance 52 may also flex and put pressure against the blade 14, as described above, when the blade 14 is positioned within any of the plurality of slots 34 and between any two given sections of the protuberance 52. The plurality of apertures 44 described above may extend through the protuberance 52 in like manner to what has been described above.

When the peg 16 is used to secure the blade 18 as described above, the peg 16 may be at least as long as the distance between the first slot 46 and the top edge 54 of the cutting face 18. Alternatively, the peg 16 may be at least as long as the distance between the bottom edge 36 and the top edge 54 of the cutting face 18. In this embodiment, the peg 16 may be long enough to protrude out of the plurality of apertures 44 when the peg 16 is pushed through all of the plurality of apertures 44.

As illustrated in the figures and as mentioned above, the surface of the cutting face 18 may be curved inward such that the cutting face 18 may form a receiving bay 56. To form the receiving bay 56, the cutting face 18 may be curved inward such that the first edge 28 of the cutting face 18 and the second edge 30 of the cutting face are located anteriorly to the rest of the surface of the cutting face 18. For example, the surface of the cutting face 16 may form a parabolic curve and the protuberance 52 may be positioned at the vertex of the parabolic curve. The curvature of the cutting face may be described by the general formula: $y=ax^2+bx+c$. Alternatively, in other embodiments, the curvature of the surface of the cutting face 16 may be described as a segment of an oval or a segment of a circle. In alternative embodiments, the surface of the cutting face 18 may not be a smooth curve, but may be any manner of shapes forming a receiving bay 56. For example, the cutting face 18 may be made up of a combination of faces including a segment of a triangle, a segment of a quadrilateral, a segment of a pentagon, a segment of a hexagon, etc. In each of the embodiments described above, the surface of the cutting face 18 forms a receiving bay 56 which may receive a cup, a pipe, or other item to be cut wherein the receiving bay 56 assists in stabilizing the item to be cut by having one or more contact points between the item to be cut and the surface of the cutting face 18.

As can be seen from the figures, specifically FIGS. 9 and 10, measurement indicia 38 may be positioned on the cutting face for the convenience of the user. For example, the measurement indicia 38 may be comprised of horizontal measurement lines 40 of varying lengths next to each of the plurality of slots 34 to indicate the position of each of the plurality of slots 34. For example, one-eighth inch, three-eighth inch, five-eighth inch horizontal measurement lines 40 may be shorter than the one-fourth inch, three-fourth inch, etc. measurement lines 40. Furthermore, the one-fourth inch, three-fourth inch, etc. measurement lines 40 may be shorter than the one-half inch, one and one-half inch measurement lines 40 and so on. Additionally, the measurement indicia 38 may further be comprised of measurement numbers 42 to indicate the position of some or all of the plurality of slots 34. For example, if the measurement tool 10 contains a plurality of slots 34 in one-eighth of an inch intervals, the measurement numbers 42 may include "⅛", "¼", "⅜", "½", etc. Alternatively, the measurement numbers 42 may only be associated with some of the plurality of slots 34. For example, if the measurement tool 10 contains a plurality of slots 34 in one-eighth of an inch intervals, the measurement numbers 42 may include "¼", "½", "¾", "1", etc. The measurement indicia 38, are not limited to these specific embodiments, but may include a variety of different layouts conforming to similar principles as described.

Figure 11:
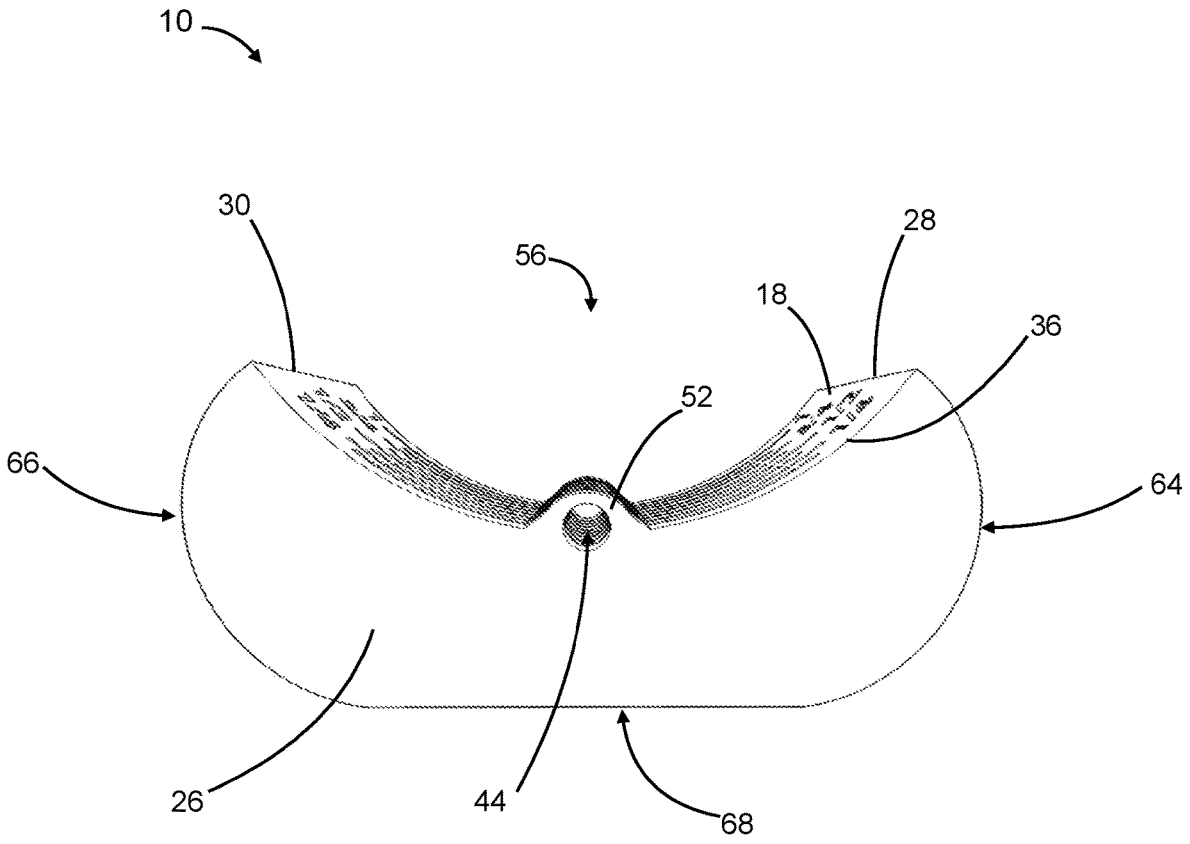
FIG. 11 illustrates a bottom perspective view of the cutting tool of FIGS. 1-10 without a blade.

As mentioned above, the solid body 12 may be comprised of a base face 26. The base face 26 may form a base of the solid body 12. The base face 26 may be flat such that when the cutting tool 10 is placed on a flat surface such as a table, counter, work bench, or other similar surface, the cutting tool 10 will be level and not wobble or have other irregularities. The base face 26, as best seen in FIGS. 11 and 12, may have a large surface area so as to allow the cutting tool 10 to be stable when placed on a flat surface. The base face 26 may have a shape resembling the shape of the side of a canoe.

Furthermore, as mentioned above, the solid body 12 may be comprised of a pressure face 22. The pressure face 22, as best seen in FIGS. 7 and 8 may, similar to the base face 26, have a large and flat surface area. The pressure face 22 may form the most superior portion of the solid body 12. The pressure face 22 may allow the user to apply a downward pressure on the solid body 12 while the cutting tool 10 is in use.

Figure 6:
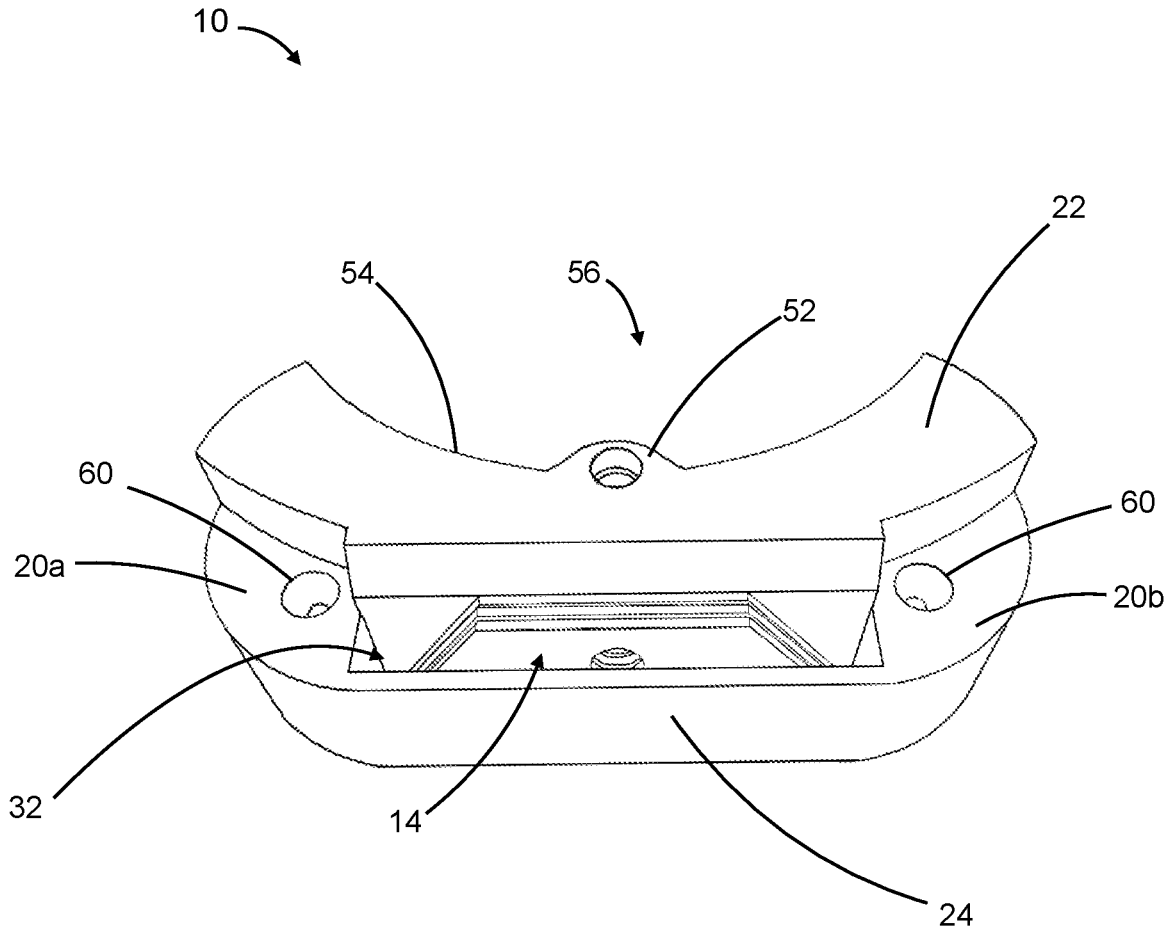
FIG. 6 illustrates a front perspective view of the cutting tool of FIGS. 1-5 without a blade.
Figure 13:
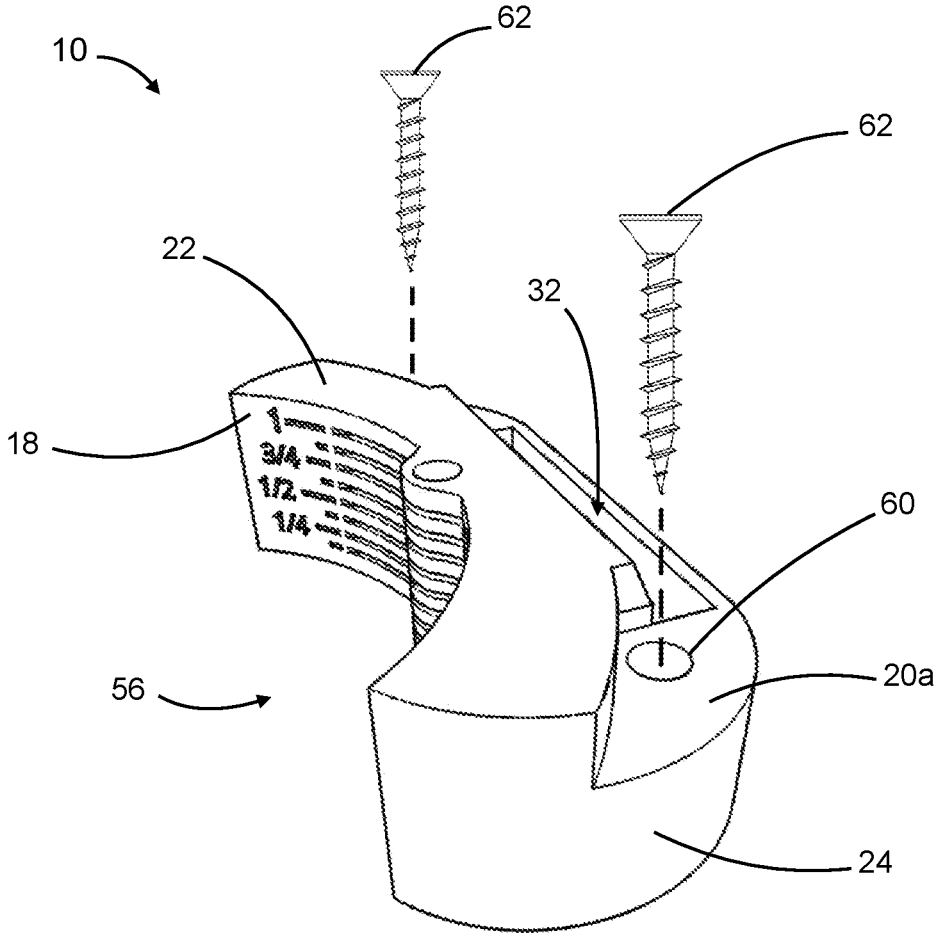
FIG. 13 illustrates an exploded side perspective view of the cutting tool of FIGS. 1-12 showing a set of screws to secure the cutting tool.
Figure 14:
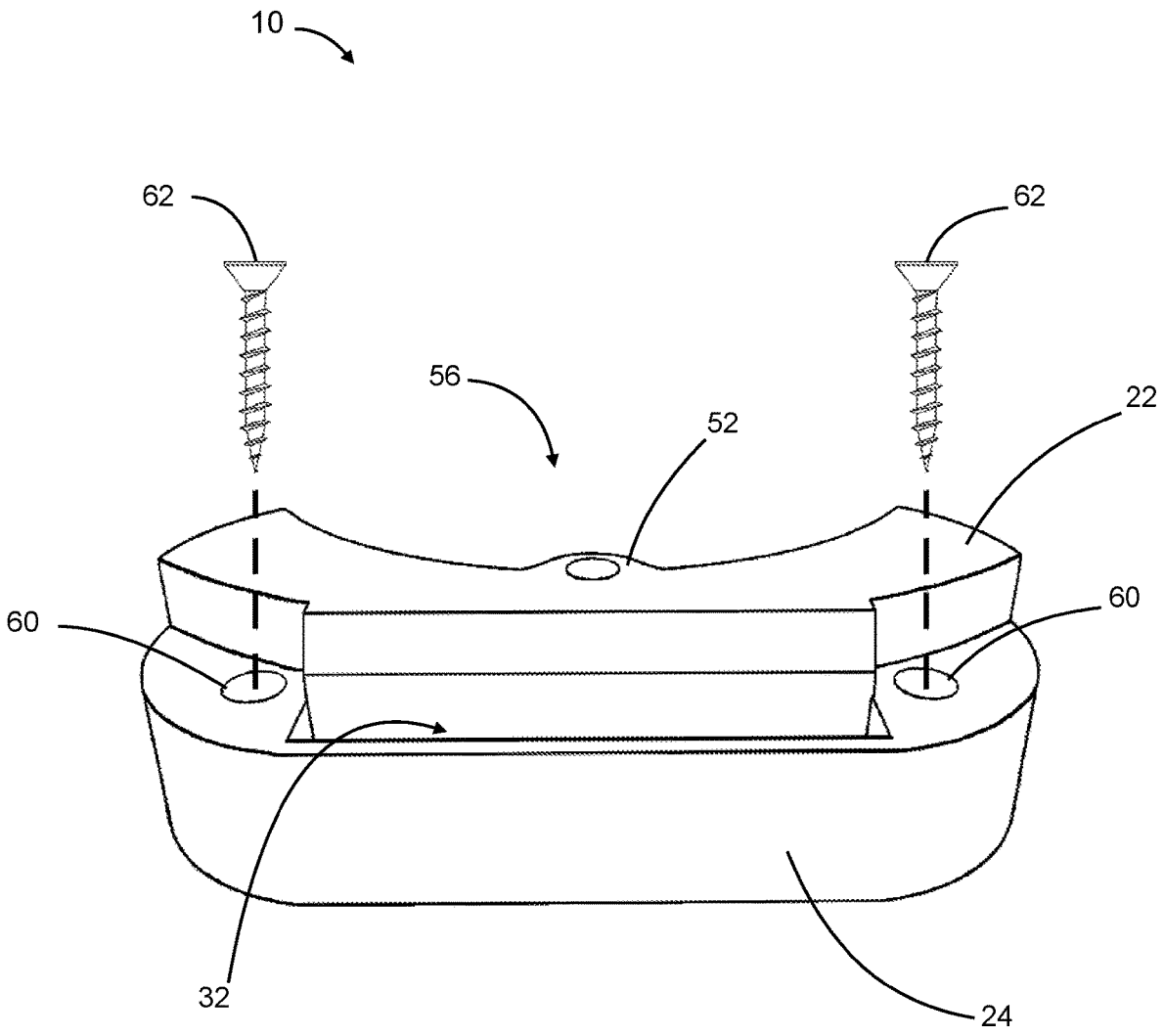
FIG. 14 illustrates an exploded back perspective view of the cutting tool of FIGS. 1-13 showing a set of screws to secure the cutting tool.

The solid body 12 may further be comprised of one or more securing faces 20. For example, the solid body 12 may be comprised of a first securing face **20*a* and a second securing face 20*b*. The one or more securing faces 20 may be best seen in FIGS. 5-8. The first securing face 20*a* may be positioned opposite of the second securing face 20***b* on the solid body. The one or more securing faces 20 may be comprised of a flat surface and may further be comprised of an aperture 60. The flat surface of the one or more securing faces 20 may allow a user to clamp the cutting tool 10 to a workbench or other flat surface where one jaw of a clamp pushes against the flat surface of the securing face and the other jaw of a clamp pushes against the underside of the workbench or other flat surface on which the cutting tool 10 is placed. As shown in FIGS. 13 and 14, the cutting tool 10 may further be comprised of one or more screws 62. The apertures 60 of the one or more securing faces 20 may each be designed to receive a screw 62. For example, the cutting tool 10 may be placed on a work bench and a screw 62 may be placed through the apertures 60 of the one or more securing faces 20 and screwed into the surface of the work bench to secure the cutting tool 10 to the work bench. As can be seen in FIGS. 6-8, the aperture(s) 60 may have a funneled design so as to receive a head of a screw 62. Alternatively, the cutting tool 10 may be secured to a workbench or other flat surface by nailing it to the surface where the nails may go through the aperture(s) 60 of the one or more securing faces 20.

As described above, the solid body 12 may be comprised of a gripping face 24. The gripping face 24 may be curved and extend around the lateral sides and back of the solid body 12. For example, the gripping face 24 may begin at the first side edge of the cutting face 18, curve around a first lateral side 64 of the solid body 12, form a straight back 66 of the solid body 18, curve around an opposite second lateral side 68 of the solid body 18 and end at the second side edge 30 of the cutting face 18. The curvature of the gripping face 24 may be ergonomically designed so as to fit within the natural curvature of a human hand when the human hand is relaxed. The gripping face 24 may allow the user to grip the cutting tool 10 when cutting an item. This allows for a different cutting technique than the cutting technique used when securing the cutting tool 10 to a workbench or other flat surface. For example, when the cutting tool 10 is not secured to a flat surface, the cutting tool 10 can be gripped with the gripping face 24 facing the palm of the user's hand, and the cutting tool 10 may be rotated around the item being cut. Alternatively, when the cutting tool 10 is secured to a workbench or other flat surface, the item being cut may be rotated within the receiving bay 56 of the cutting face 18. The user may still place a hand around the gripping face 24 for this cutting technique if desired.

Although several embodiments have been described in detail for purpose of illustration, various modifications may be made without departing from the scope and spirit of the invention. Accordingly, the invention is not to be limited except as by the appended claims.

What is claimed is:

1. A cutting tool comprising:

a solid body comprised of a receiving bay, wherein the receiving bay recedes into the solid body, wherein the receiving bay is comprised of a plurality of horizontal slots; and a flat blade having a single sharp edge and a spine end opposite of the sharp edge, wherein the sharp edge has a first end, a second end and a length, wherein the flat blade may be removably secured in any one of the plurality of slots of the receiving bay with the spine end, the first end of the sharp edge and the second end of the sharp edge within the slot and the length of the sharp edge of the blade out of the slot such that the sharp edge does not extend outside of the receiving bay.

2. The cutting tool of claim 1 wherein the solid body further comprises two apertures running generally orthogonally to the plurality of horizontal slots and positioned posteriorly to the plurality of horizontal slots, wherein the two apertures are configured to each receive a screw so as to secure the solid body to a working surface while the cutting tool is in use.

3. The cutting tool of claim 1, wherein the solid body further comprises a compartment, wherein the compartment is positioned posteriorly to the cutting face and wherein the compartment is configured to store at least one spare blade.

4. The cutting tool of claim 1, wherein the plurality of slots are spaced apart at one-eighth of an inch intervals.

5. The cutting tool of claim 1, wherein the receiving bay is further comprised of measurement indicia.

6. The cutting tool of claim 1, wherein the receiving bay is further comprised of at least one contact face configured to stabilize an item being cut, wherein the at least one contact face is positioned within the receiving bay and anteriorly to the plurality of horizontal slots.

7. The cutting tool of claim 1, wherein the receiving bay is further comprised of a protuberance running generally orthogonally to the plurality of horizontal slots such that the plurality of horizontal slots divide the protuberance into a plurality of sections.

8. A cutting tool comprising:

a solid body comprised of a cutting face, the cutting face having a bottom edge and a top edge, and a protuberance, wherein the cutting face is curved inwardly so as to form a receiving bay, wherein a plurality of horizontal slots are positioned within the cutting face between the bottom edge and the top edge, wherein the protuberance is positioned vertically at a vertex of the cutting face and extending from the bottom edge to the top edge of the cutting face, wherein the plurality of horizontal slots divide the protuberance into a plurality of sections; and a blade having a sharp edge, a spine, and an aperture located between the sharp edge and the spine, wherein the blade may be removably secured in any one of the plurality of slots with the spine end and the aperture of the blade within the slot and the sharp edge of the blade out of the slot and facing away from the cutting face.

9. The cutting tool of claim 8, wherein the solid body further comprises a plurality of vertically aligned apertures positioned through the sections of the protuberance of the solid body.

10. The cutting tool of claim 9, wherein the aperture of the blade aligns with the plurality of apertures of the solid body when the blade is secured within any one of the plurality of slots.

11. The cutting tool of claim 10, further comprising a peg, wherein the peg fits through the plurality of apertures of the solid body as well as the aperture of the blade when the blade is secured within any of the plurality of slots.

12. The cutting tool of claim 11, where in the peg is at least as long as the vertical distance between the bottom edge and the top edge of the of the cutting face.

13. The cutting tool of claim 8, further comprising a gripping face, wherein the cutting face further comprises a first side edge and a second side edge, wherein the second side edge is opposite of the first side edge and wherein the gripping face begins at the first side edge of the cutting face with an outward curve, forms a straight back of the solid body, and curves again to connect with the second side edge of the cutting face.

14. A cutting tool comprising:

a solid body comprised of a receiving bay and at least one securing face, wherein the receiving bay is comprised of at least one contact face, recedes into the solid body, is anteriorly positioned and facing forward and wherein the at least one securing face is positioned generally posteriorly and orthogonally to the receiving bay and facing upwards; and a blade having a sharp edge and a spine, wherein the blade is removably secured within the solid body such that the sharp edge of the blade is exposed within the receiving bay and positioned posteriorly to the at least one contact face of the receiving bay.

15. The cutting tool of claim 14, wherein the at least one securing face is further comprised of an aperture running entirely through the solid body and configured to receive a screw so as to secure the cutting tool to a working surface.

16. The cutting tool of claim 14, wherein the solid body is further comprised of a pressure face, wherein the pressure face faces upwards and is positioned posteriorly and orthogonally to the receiving bay and superiorly to the securing face.

17. The cutting tool of claim 14, wherein the solid body is further comprised of a compartment located posteriorly and inferiorly to the pressure face and adjacent to the at least one securing face, wherein the compartment is configured to store at least one spare blade.

18. The cutting tool of claim 14, wherein the solid body is further comprised of a gripping face, wherein the gripping face forms a first lateral side, a back, and a second lateral side of the solid body.

19. The cutting tool of claim 14, wherein the receiving bay is further comprised of a plurality of slots, wherein the blade may be removably secured within any one of the plurality of slots such that the spine of the blade is within the slot and the sharp edge of the blade is exposed within the receiving bay.

20. The cutting tool of claim 19, wherein the plurality of slots are positioned apart at one-eighth of an inch intervals.

* * * * *